US006279970B1

(12) United States Patent
Torres

(10) Patent No.: US 6,279,970 B1
(45) Date of Patent: Aug. 28, 2001

(54) AUTOMATIC KNOT-TYING DEVICE

(76) Inventor: Michael Torres, 4736 18th Ave. NE., Seattle, WA (US) 98105

( * ) Notice: Subject to any disclaimer, the term of this patent is extended or adjusted under 35 U.S.C. 154(b) by 0 days.

(21) Appl. No.: 09/598,017

(22) Filed: Jun. 20, 2000

(51) Int. Cl.[7] ..... B65H 69/04
(52) U.S. Cl. ..... 289/1.5; 289/1.2; 289/17; 289/18.1
(58) Field of Search ..... 289/1.2, 1.5, 2, 289/17, 18.1

(56) References Cited

U.S. PATENT DOCUMENTS

| | | | | |
|---|---|---|---|---|
| 3,057,648 | | 10/1962 | Schwarz et al. . | |
| 3,391,440 | * | 7/1968 | Harms | 289/17 |
| 4,094,342 | | 6/1978 | Nishikawa et al. . | |
| 4,502,905 | | 3/1985 | Jung et al. . | |
| 4,534,817 | * | 8/1985 | O'Sullivan | 289/17 |
| 4,558,894 | | 12/1985 | Detterbeck et al. . | |
| 5,505,504 | * | 4/1996 | Sato et al. | 289/2 |

FOREIGN PATENT DOCUMENTS 2533640 2/1977 (DE) .

* cited by examiner

*Primary Examiner*—John J. Calvert
*Assistant Examiner*—Gary L. Welch
(74) *Attorney, Agent, or Firm*—Polly L. Oliver

(57) ABSTRACT

An automatic knot-tying device for tying a discrete knot about a workpiece, such as a bundle of wires, is disclosed herein. The present invention works by pulling a filament transversely around the workpiece. The preferred embodiment of the device comprises a hand-held housing and a knot-tying mechanism within that housing comprising a hollow nozzle for leading the filament toward the workpiece, a wrapping ring for wrapping the filament around the workpiece, and a plurality of pins that extend into and retract out of the path of the filament to form the knot. The operation is finished by cinching and cutting the loose filament so that the resulting knot is discrete and secure. Also disclosed is a method for automatically tying a knot around a workpiece by pulling, instead of pushing a filament around the workpiece.

19 Claims, 17 Drawing Sheets

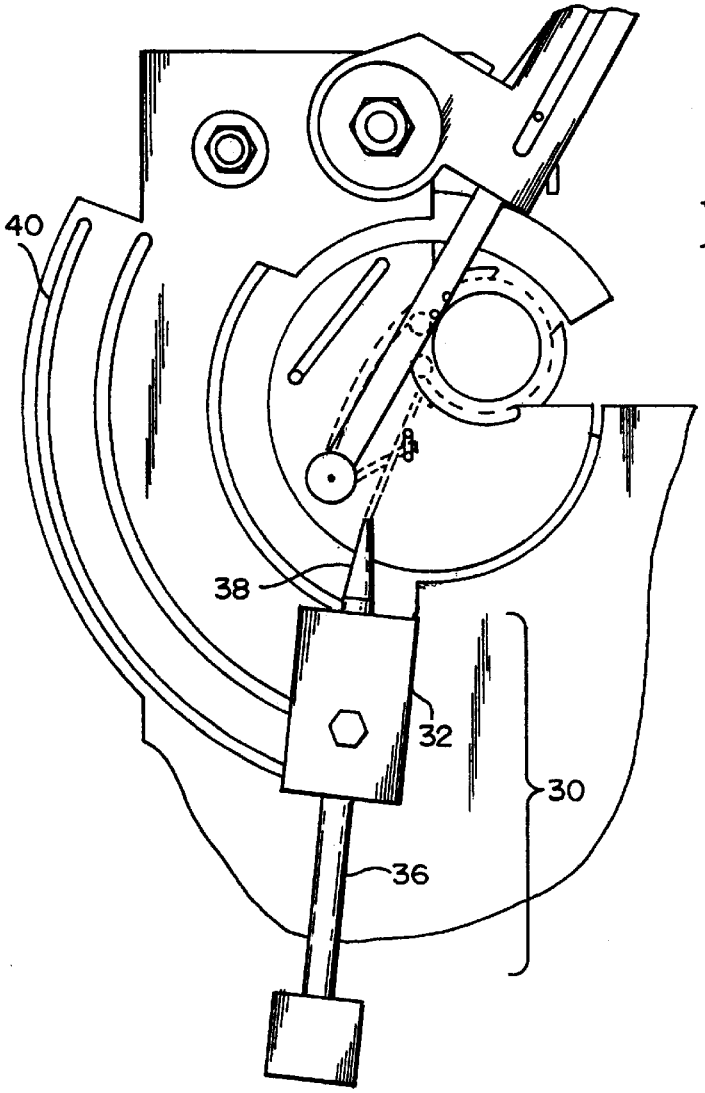
FIG. 13A
FIG. 13B
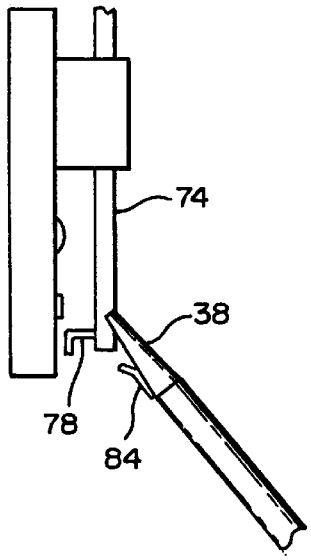
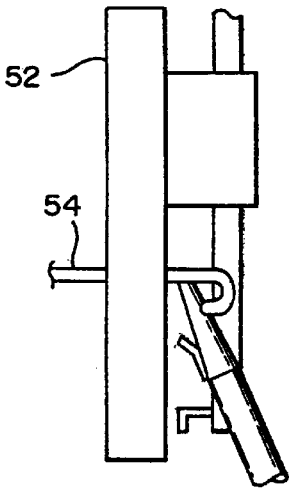
FIG. 14

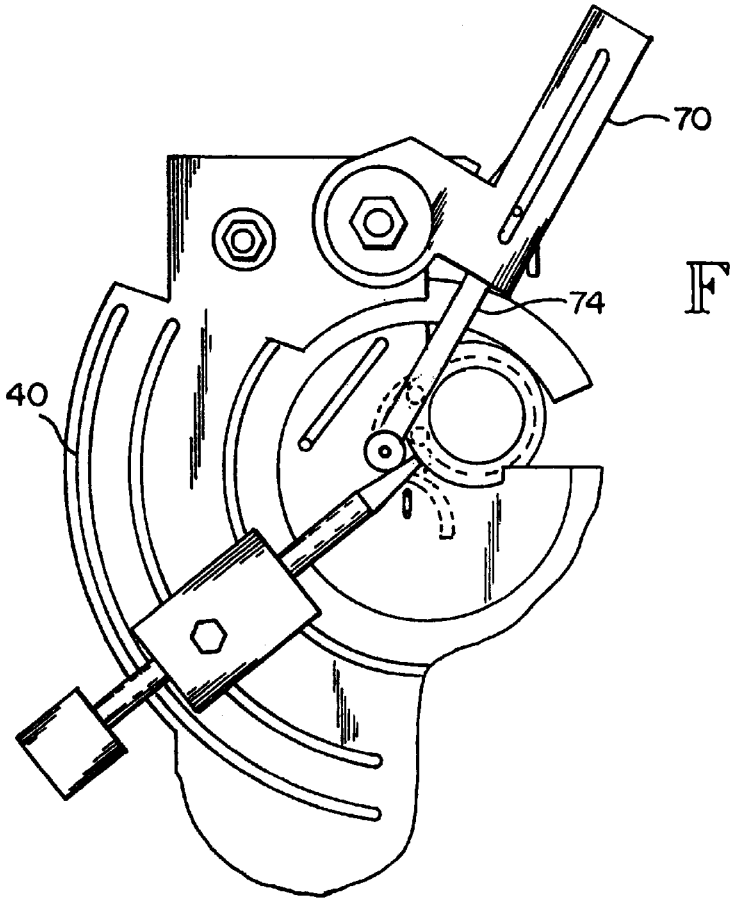
FIG. 15A
FIG. 15B
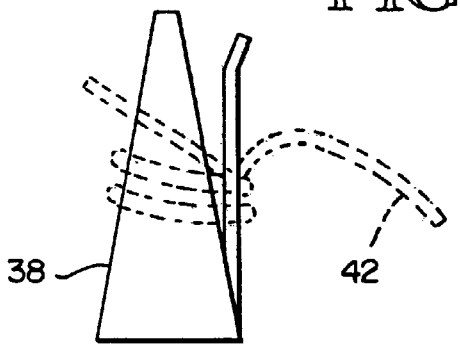

AUTOMATIC KNOT-TYING DEVICE

FIELD OF THE INVENTION

This invention relates generally to automatic knot-tying devices and more particularly to an automatic knot-tying device for tying a knot around a generally cylindrical target item.

BACKGROUND OF THE FIELD

In many industries, both military and commercial, such as the aircraft, automotive, and appliance industries, wire bundles, or harnesses, are used extensively in the manufacturing processes of various products. Each bundle, or harness, generally comprises two or more wires that customarily are tied together at various points along their lengths to help ensure safety and durability, as well as a generally clean design.

Individually tying the bundle points by hand is costly, labor-intensive, and time-consuming, and often leads to carpal tunnel syndrome, or other physical injury, in the operator. With these problems in mind, several patented inventions have been directed toward automating the wire-tying process. One such device, that described in German Offenlegungsschrift U.S. Pat. No. 2,533,640 and improved in U.S. Pat. No. 4,558,894 to Detterbeck et al, is a hand-held pistol-like apparatus that forms a continuous crocheted tying structure around and along a bundle of wires. Even Detterbeck's improvement, however, does not actually tie a knot around the bundle: it simply pulls taut a predetermined number of loops. The device, therefore, is limited because it is not capable of tying individual knots at discrete points along the bundle.

Another patented device is described in U.S. Pat. No. 4,094,342 to Nishikawa et al. Nishikawa's device uses guide channels along the inside surface of the bundle holding elements to guide the string or cord around the wire bundle into the shape of a knot. The string is then pulled taut and cut. Several problems, including jamming and inconsistent knot quality, are associated with the Nishikawa device because it pushes, rather than pulls, the string around the bundle.

One feature of knot-tying is that a second pass of the string around the bundle must be laid in front of or behind a first pass. The prior art has not dealt with this problem very successfully; instead, prior art devices have tried simply to lay the string in patterns described by guide channels in the holding elements themselves. The Nishikawa device, and other devices, particularly the one described in U.S. Pat. No. 3,057,648 to Schwarze et al, use guide channels of differing depths to result in criss-crossing passes of the string. In a different approach, the device disclosed in prior art patent to Jung et al., U.S. Pat. No. 4,502,905, uses a transverse pin with a hook to grab the second pass of the string and draw it back across the first pass.

The Jung device illustrates another problem in the prior art—that of finishing the knot. After the string is laid around the bundle, the Jung device heats and bonds the string instead of tying a knot. Such heating, or other type of fusing or bonding, as well as the use of plastic, generic cotton string, or other fabric are frequently not acceptable because of the harsh environments encountered by many installations of wire bundles. Depending upon the particular industry and the application of the product, these bundles may be placed in environments of extreme temperature, vibration, radiation, or other types of shock. To withstand these conditions while maintaining the integrity of the knot, many applications require the use of "lace," a particular type of flexible string-like material.

SUMMARY OF THE INVENTION

One aspect of the present invention comprises a hand-held housing with an activating button or switch so that the user can easily manipulate the device and apply a knot at any desired discrete location, or a series of discrete locations, along a bundle. The housing defines a generally U-shaped opening into which the bundle fits with the bundle longitudinal axis generally transverse to the handle. The user does not have to manipulate the bundle or come into physical contact with it at all; he simply thrusts the device around the bundle and presses the activating button.

The housing contains a knot-tying mechanism that actually ties a knot, i.e., not loops or chains of loops, around the wire bundle. With the present invention, any of several different knots could be tied, with different arrangements and indexing of pins and hooks; however, in the preferred embodiment, it has been chosen to tie a clove hitch around the bundle and then tie a surgeon's knot to secure the clove hitch, because this combination of clove hitch and surgeon's knot is the FAA-approved method of tying wire harnesses. Military specifications also require use of the clove hitch/surgeon's knot combination.

The knot-tying mechanism of the device operates in two distinct stages. In the first stage, the mechanism wraps and tightens the clove hitch around the bundle, and then in the second stage, the mechanism ties the surgeon's knot to secure the wrapped clove hitch. The mechanism then resets itself for the next operation. A continuous supply of lace, or other filament, is fed to the device by a belt-mounted or housing-mounted spool, or some other method. The entire process from the moment the device engages the bundle to the moment the device disengages the bundle, leaving a precisely tied, tight, and finished discrete knot, takes approximately 5 seconds, using the preferred embodiment. Of course, alternate embodiments, particularly with alternate controlling means, can easily speed up or slow down the processing time.

The knot-tying mechanism of the preferred embodiment comprises a nozzle, from which the lace issues, a wrapping ring, which rotates around the bundle, completely circumscribing it, and various reciprocating, twisting, and sliding pins and hooks that extend and retract into and out of the path of the lace proximate the bundle.

The nozzle of the preferred embodiment of the present invention not only delivers the lace to the knot-tying mechanism, but also acts as a key element of the knot-tying processes. Because the nozzle itself is angled and tapered as it approaches the bundle, it can control the laying of a second pass of lace across a first pass around the bundle, thus eliminating the need for transverse pins with hooks to pull or push the lace of the second pass. Because the nozzle twists upon its own longitudinal axis, it is able to play a large role in the knot-tying process, thereby greatly reducing the overall number of pins and hooks necessary.

The wrapping ring of the preferred embodiment of the present invention is linked to the housing so that it can swing about the bundle, completely circumscribing it, as many times as is necessary for the desired knot design. A clamp on the wrapping ring temporarily holds the free end of the lace issuing from the nozzle, and is preset to release the lace at the proper time during the knot-tying process. The combination of the wrapping ring and the clamp, instead of holding elements and guide channels, pulls the lace around the bundle instead of pushing it, thus eliminating the problems associated with pushing, such as jamming and inconsistent knot quality.

In the preferred embodiment, the pins and hooks that reciprocate so as to extend into and retract out of the proximity of the knot are also capable of twisting on their own axes. Such twisting action, in combination with holding grooves on only one side of the pin, allows that the lace may be held as necessary and then immediately released so as to provide slack in the knot-tying process at the appropriate time. Because the pins and hooks are so multi-functioned, the number of elements needed to tie the knot is minimized.

When the user first engages the preferred embodiment of the device with the bundle, by placing the bundle generally transversely within the opening of the housing, the knot-tying mechanism is in the initial set-up position. In this initial set-up position, the free end of the lace issuing from the nozzle is held in place on the wrapping ring by the clamp. Once actuated, by the button or other actuation method, the mechanism begins the clove hitch process. With the lace being continuously fed from the nozzle, the wrapping ring rotates around the bundle, carrying the lace with it, and various pins and hooks, which in the preferred embodiment are specifically referred to as the loop slack pin, the main hook, the first clove hitch retaining pin, and the main slack pin come into play at various times to snag, tighten, or guide the lace.

Once the clove hitch is complete and tight, the knot-tying mechanism then ties and finishes a surgeon's knot to secure the wrapped clove hitch and finish the procedure. In this surgeon's-knot tying process, the various reciprocating, twisting, and sliding pins involved are specifically referred to in the preferred embodiment as the second clove hitch retaining pin, the nozzle tab, the main slack pin, the tail cincher, and the surgeon's knot retaining pin. Also during this process, the nozzle assembly rotates around the bundle, changing its orientation thereto, the nozzle tube extends and retracts within its own housing, and the nozzle tube twists about its own axis.

In the preferred embodiment, once the surgeon's knot is complete, a cutting edge engages and severs the lace so that the knot is stand-alone and discrete. The lace is then reattached to the clamp on the wrapping ring, and the mechanism is ready for the next engagement.

BRIEF DESCRIPTION OF THE DRAWINGS

FIG. 13 is a detail section view of an intermediate step in the surgeon's knot process;

FIG. 13*b* is a front view of the intermediate step of FIG. 13*a;*

FIG. 14 is a front detail section view of an intermediate step in the surgeon's knot process;

FIG. 15*a* is a detail section view of an intermediate step in the surgeon's knot process;

FIG. 15*b* is a front view of the intermediate step of FIG. 15*a;*

DETAILED DESCRIPTION OF THE PREFERRED EMBODIMENT

Figure 1A:
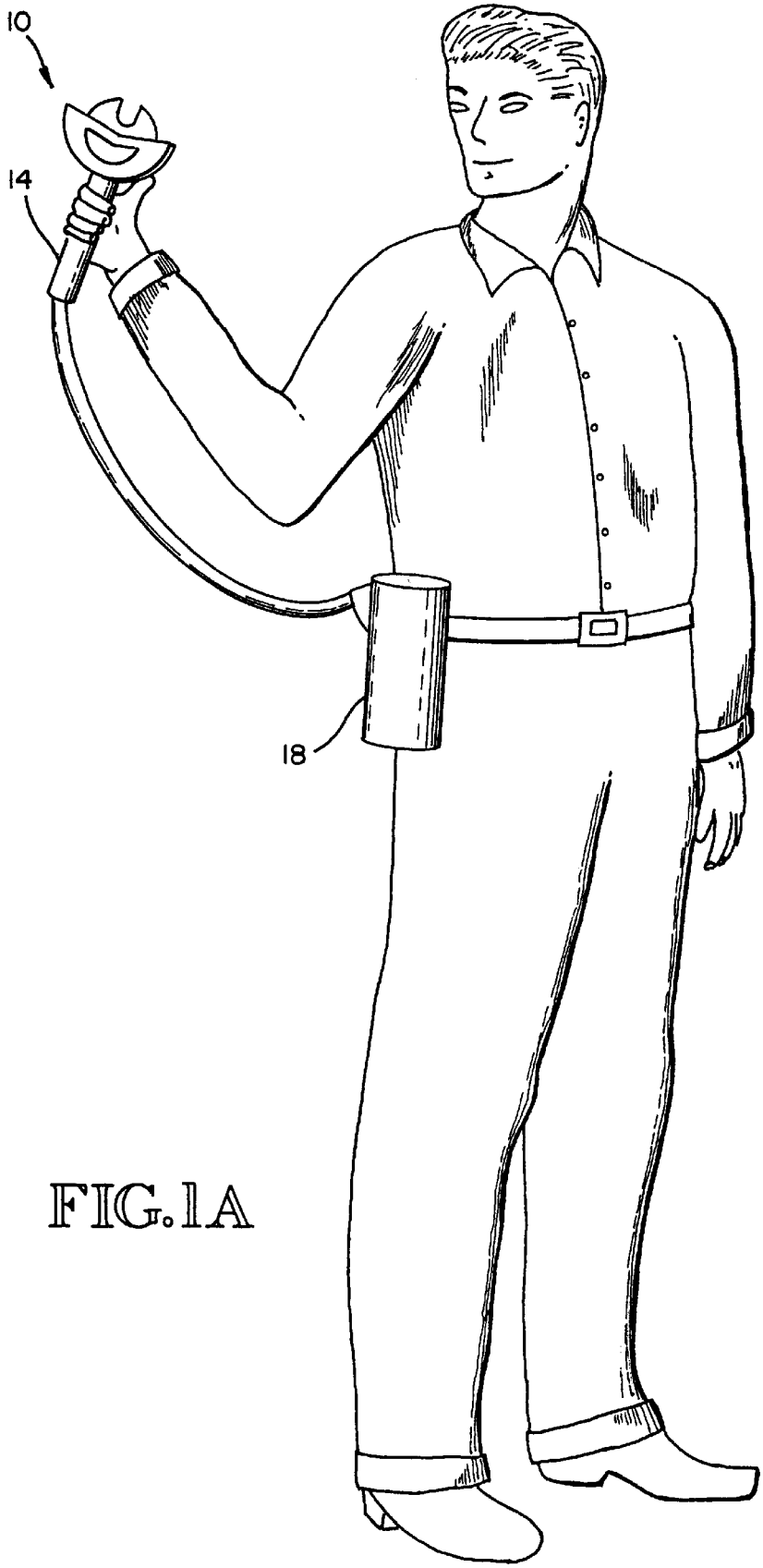
FIG. 1*a* is a perspective view of the preferred embodiment of the invention of the automatic knot-tying device as it is held by a user.
Figure 1B:
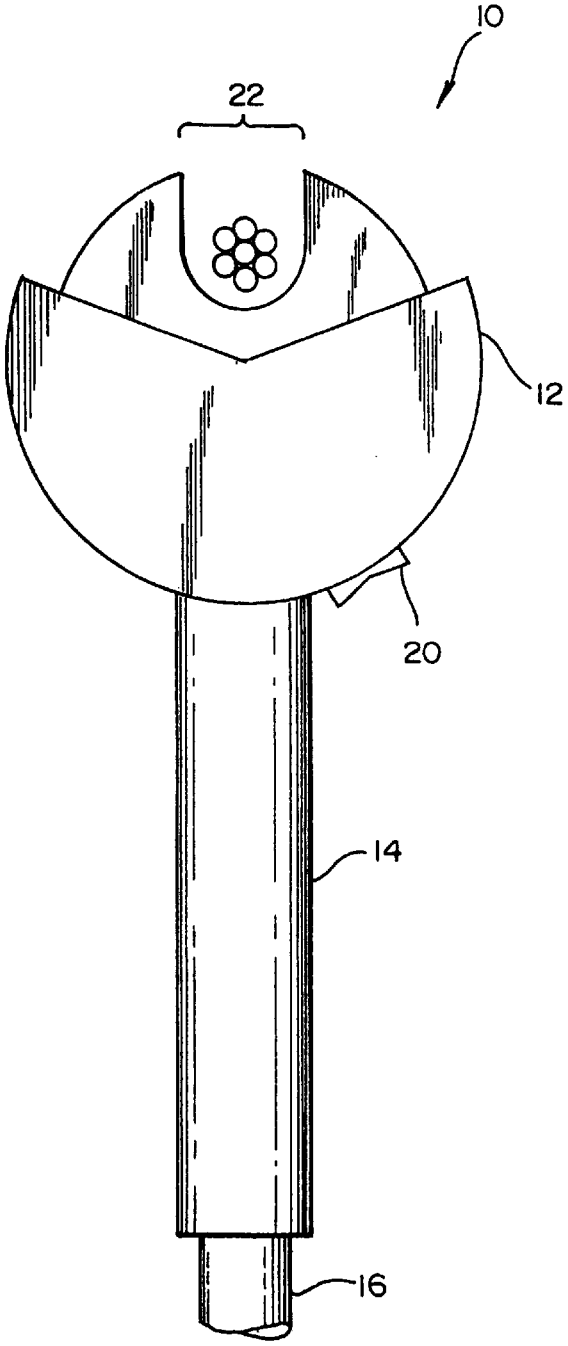
FIG. 1*b* is a side view of the preferred embodiment of the invention of the automatic knot-tying device.

FIG. 1*a* is a perspective view of the preferred embodiment of the invention of the automatic knot-tying device 10 as it is intended to be held by a user. The lace supply 18 in the preferred embodiment is a belt-mounted spool. In alternate embodiments, the lace supply could be a spool or reel mounted to the handle 14 or other location. FIG. 1*b* is a side view of the preferred embodiment of the invention of the automatic knot-tying device 10. The device 10 comprises a housing 12 attached to a handle 14 with power connection 16. The preferred embodiment also comprises a button 20 for actuating the device. However, in alternate embodiments, there could be a trigger, proximity sensor, or other device mounted on the housing for purposes of actuation.

Figure 1C:
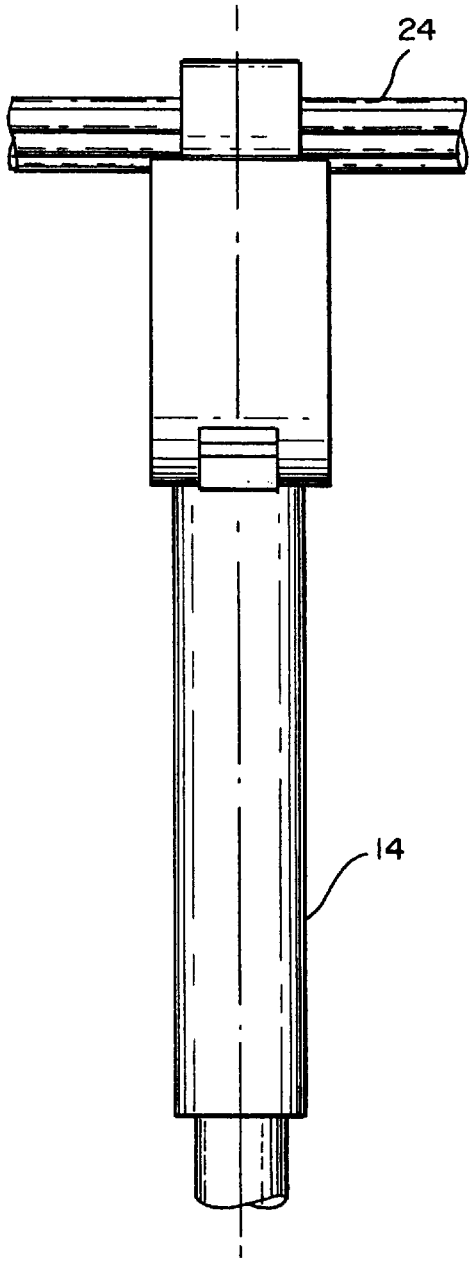
FIG. 1*c* is a front view of the device showing the center line along which the remaining detail views are generally taken.

In the preferred embodiment, the housing 12 defines a generally U-shaped opening 22 for accommodating the workpiece, usually a bundle of wires 24. The opening 22 fits around the bundle 24 such that the handle 14 of the device 10 is generally orthogonal to the longitudinal axis of the bundle 24, as seen in FIG. 1*c*. FIG. 1*c* is a front view of the device 10 showing the section lines along which the remainder of the detail views will generally be taken.

Figure 2:
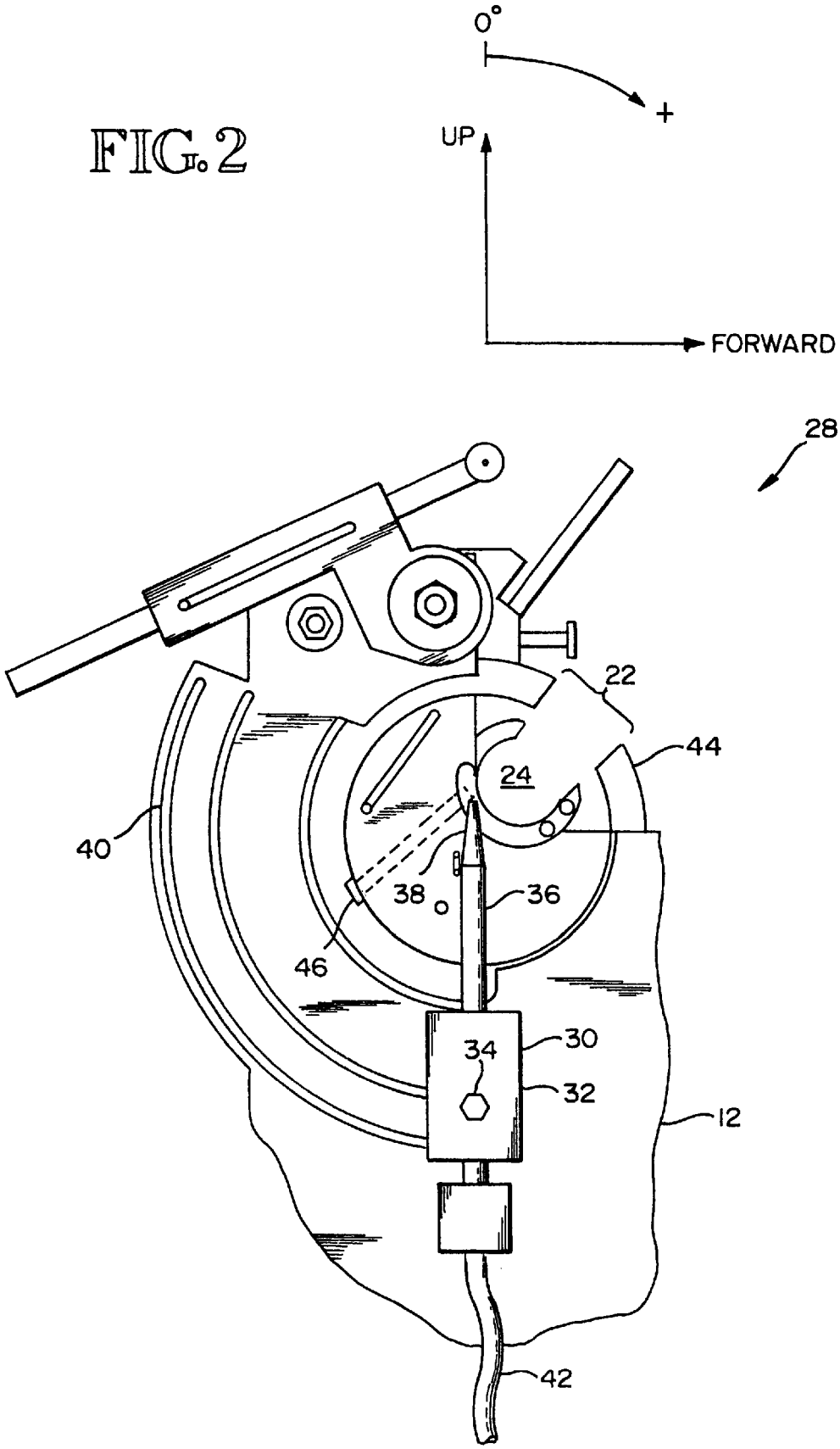
FIG. 2 is a detail section view showing the initial set-up configuration of the knot-tying mechanism.

The knot-tying mechanism 28 is shown in FIG. 2 in the initial set-up configuration. FIG. 2 is a detail view of the mechanism 28 taken along the section lines shown in 1*c*. The mechanism 28 comprises a nozzle assembly 30, which is mounted onto two nozzle tracks 40, which, in the preferred embodiment, are designed in a circular arc and defined by the housing 12. The tracks 40 in the preferred embodiment are coplanar with the plane defined by the wrapping ring 44, hereinafter referred to as the reference plane. The lace 42, or other filament, is delivered from the supply 18 through the nozzle tube 36 and out the nozzle tip 38. The free end of the lace 42 is then clamped onto the wrapping ring 44 by use of the clamp 46. The bundle 24 fits into the opening 22 such that it is entirely within the circle defined by the wrapping ring 44.

In the initial set-up configuration, the nozzle assembly 30 rests at the downward end of the nozzle tracks 40 with the nozzle tube 36 extending generally vertically from the nozzle housing 32 into the proximity of the wire bundle 24. (The nozzle set screw 34 is tightened so as to allow the nozzle tube 36 to reciprocate through the housing 32.) The nozzle tube 36 is not coplanar with the wrapping ring 44, but instead approaches the reference plane at an angle of approximately 25 degrees. The lace 42 is relatively taut but not restrained within the nozzle tube 36 so that it is allowed to issue freely from the nozzle tip 38. The wrapping ring 44 initially rests such that the clamping screw is positioned at approximately 250 degrees.

Figure 3:
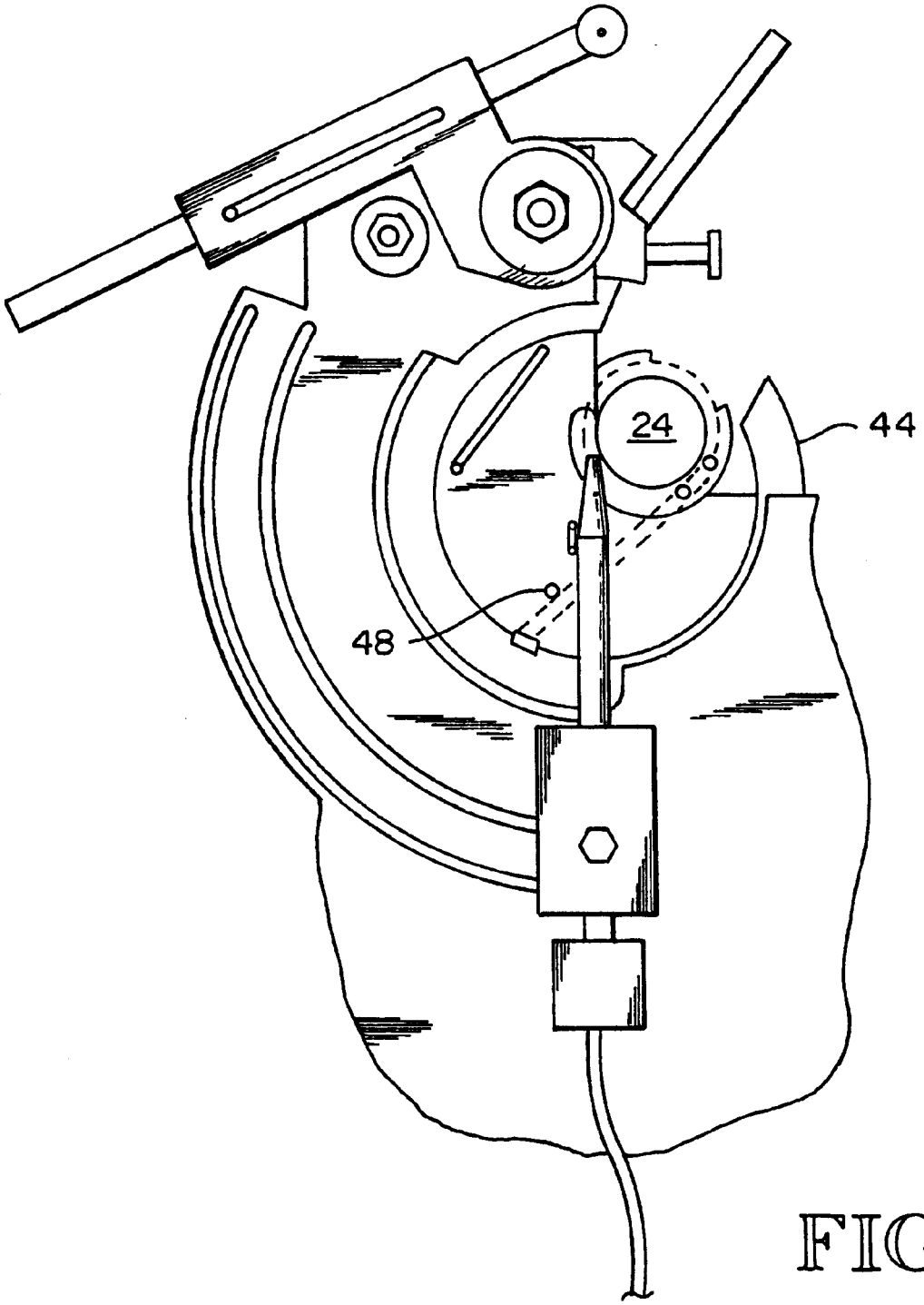
FIG. 3 is a detail section view showing an intermediate step in the clove hitch process.

Upon activation by the button or other signaling device, the wrapping ring 44 begins to rotate clockwise in the first step of the knot-tying procedure, i.e., tying the clove hitch. FIG. 3 shows an intermediate position after the wrapping ring 44 has rotated approximately 300 degrees clockwise, placing the loop slack pin 48, which is oriented generally orthogonal to the reference plane, within the path of the lace 42. The lace 42 has wrapped partially around the bundle 24, and the clamp 46 is now at approximately 200 degrees.

Figure 4A:
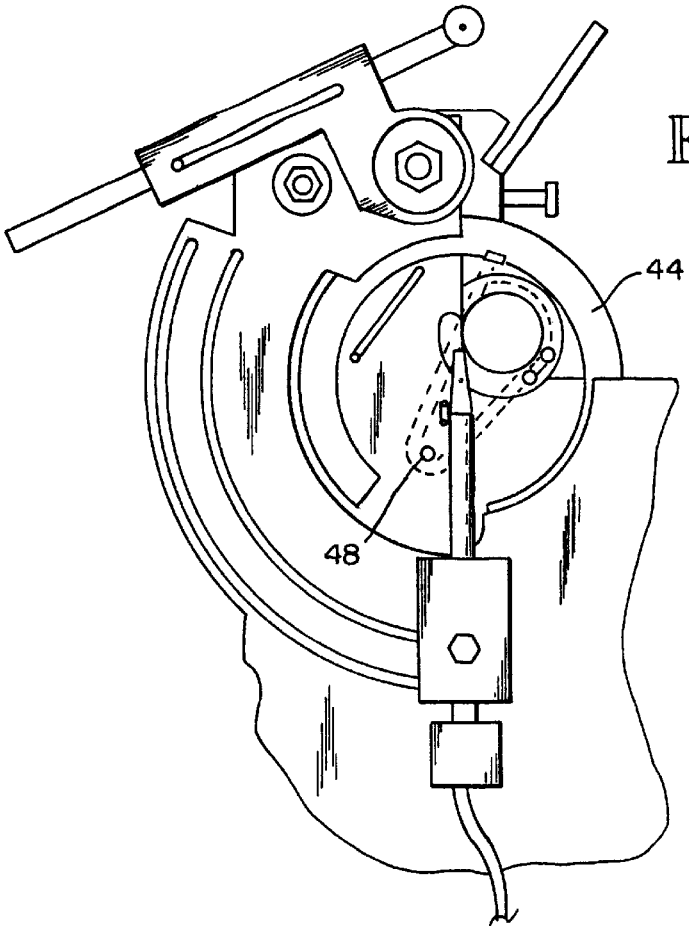
FIG. 4*a* is a detail section view showing an intermediate step in the clove hitch process.

FIG. 4*a* shows a later intermediate position after the wrapping ring 44 has continued an additional 145 (approx.) degrees clockwise rotation around the bundle 24. The groove 50 in the loop slack pin 48 (shown in FIG. 4*b*) is initially oriented generally away from the opening 22 such that the groove 50 has caught and loosely retained the lace 42, which has now come into contact once again with the bundle 24, completing a closed loop formation around the bundle 24. The clamp is now positioned at approximately 15 degrees.

Figure 4B:
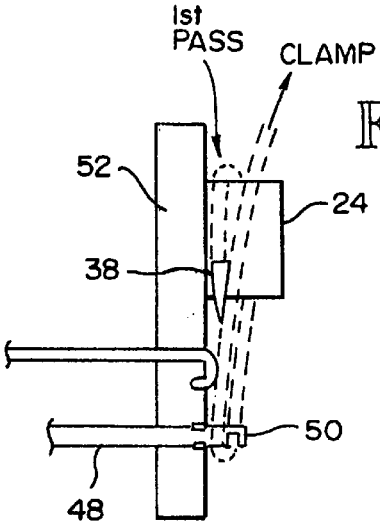
FIG. 4*b* is a front view showing the intermediate step of FIG. 4*a;*

The front view of FIG. 4*b* shows that because of the proximity of the nozzle tip 38 to the extension pin housing wall 52, the angle of the nozzle tube 36 (not shown in this figure), and the taper of the nozzle tip 38, the second pass of the lace 42 over the top of the bundle 24 will be in front of (more forward from the extension pin housing wall 52) the first pass of the lace 42.

Figure 5:
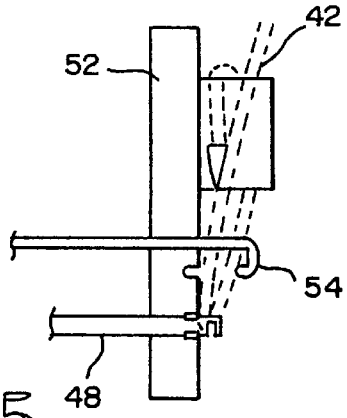
FIG. 5 is a front view of an intermediate step in the clove hitch process.

In FIG. 5, which shows a next step before the wrapping ring 44 rotates further, the hook 54, which is oriented generally orthogonal to the reference plane, extends from the extension pin housing wall 52 to its maximum position forward. The loop slack pin 48 retracts back toward the extension pin housing wall 52 in order to avoid snagging the second pass of the lace 42 but not so far as to pin the lace 42 against the wall 52.

Figure 6A:
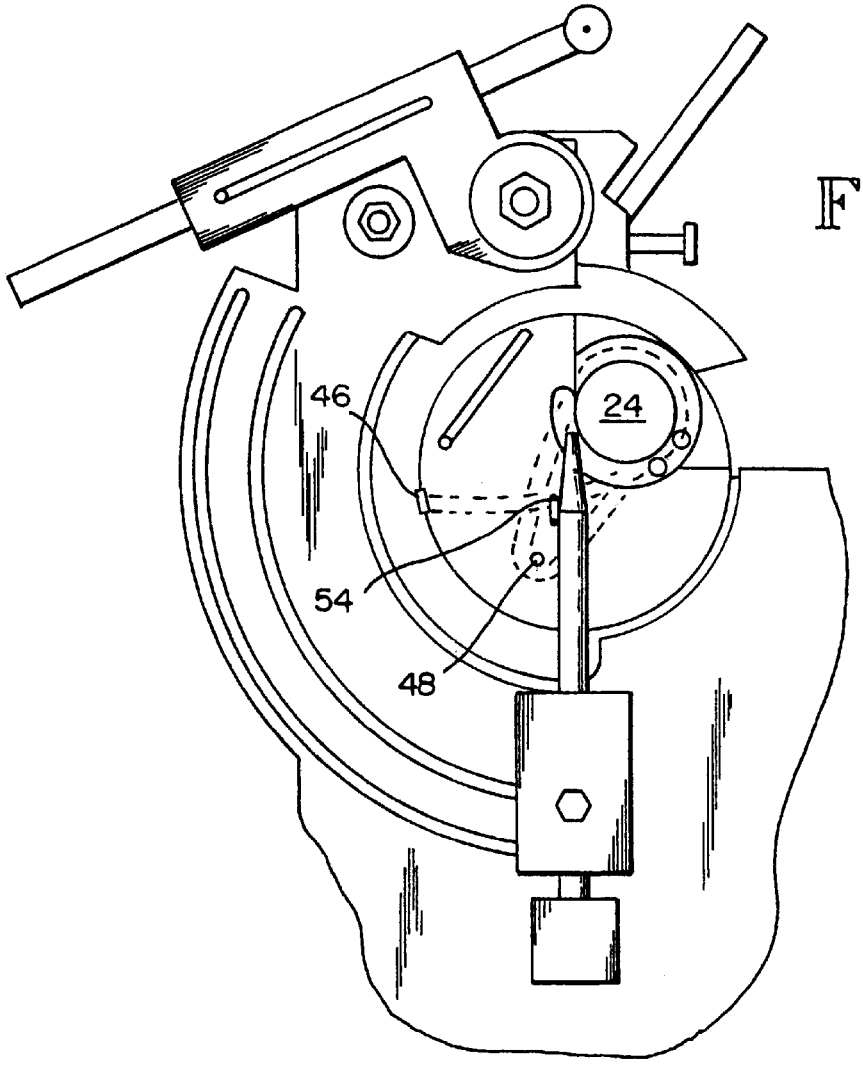
FIG. 6*a* is a detail section view of an intermediate step in the clove hitch process.
Figure 6B:
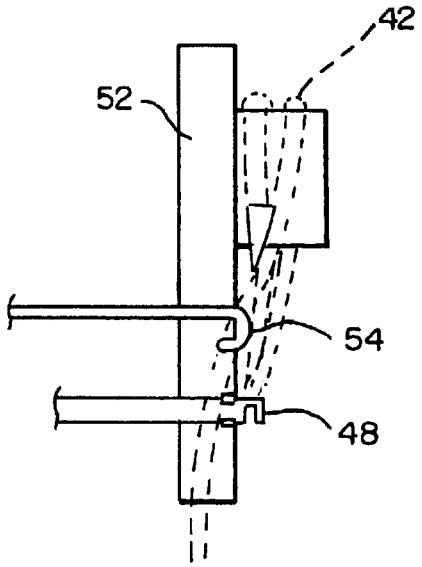
FIG. 6*b* is a front view of the intermediate step of FIG. 6*a;*

After an additional rotation, of approximately 270 degrees, of the wrapping ring 44, as shown in FIG. 6*a*, the hook 54 has caught the lace 42 on the second pass around the bundle 24, causing a "V-shaped" formation in the lace 42. The first leg of the "V" extends from a point on the periphery of the bundle 24 toward the loop slack pin 48, and the second leg extends toward the hook 54. The clamp 46 is now at approximately 260 degrees. The hook 54, in FIG. 6*b*, now recedes back into the extension pin housing wall 52, trapping the lace 42 and pinning it against the wall 52. The clamp 46 then releases the lace 42, leaving the free end of the lace 42 projecting from the far side of the hook 54.

Figure 7A:
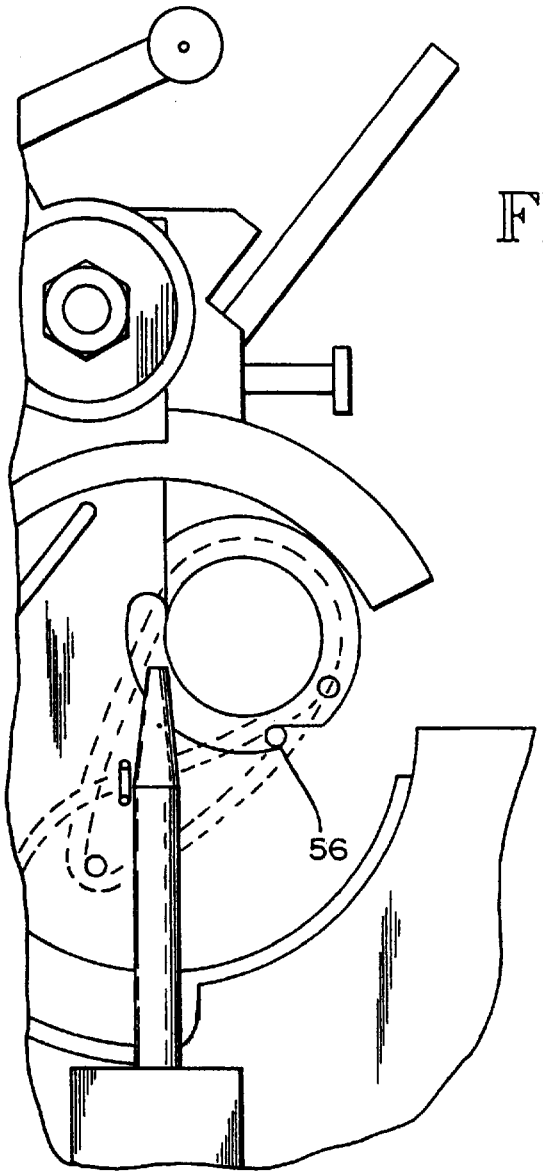
FIG. 7*a* is a detail section view of an intermediate step in the clove hitch process.
Figure 7B:
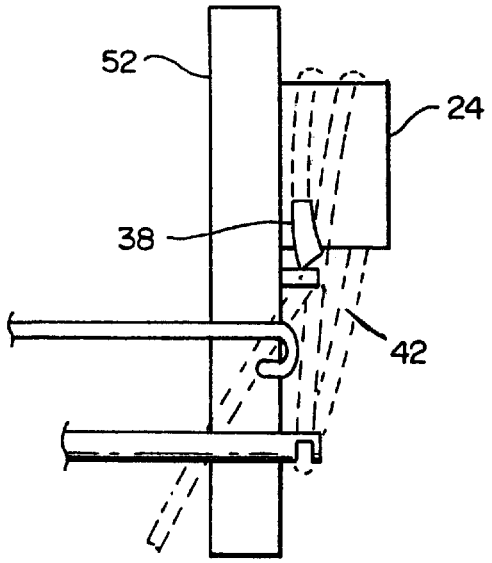
FIG. 7*b* is a front view of the intermediate step of FIG. 7*a;*

FIGS. 7*a* and 7*b* illustrate the continuation of the clove hitch process, with the first clove hitch retaining pin 56, which is oriented generally orthogonal to the reference plane, extending from the extension pin housing wall 52 at the apex of the "V" formation. The groove 58 (not shown) in the first clove hitch retaining pin 56 is initially oriented generally toward the bundle 24 so as to be facing the second leg of the "V."

Figure 8:
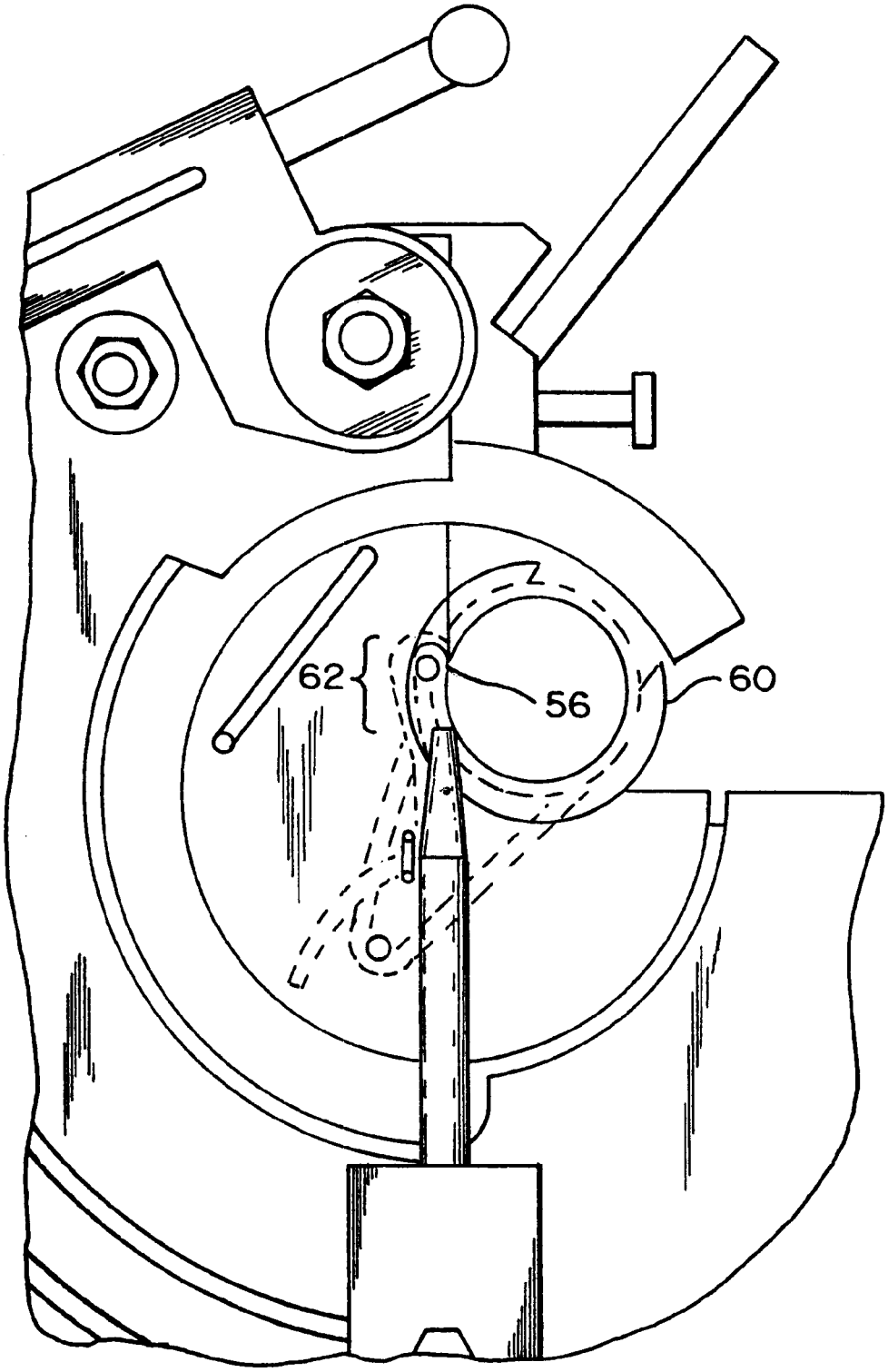
FIG. 8 is a detail section view of an intermediate step in the clove hitch process.

At this point, the lace 42 being fed from the nozzle tip 38 must be clamped tightly within the nozzle for the duration of the clove-hitch process. FIG. 8 shows how the first clove hitch retaining pin 56 begins to rotate clockwise (within the track defined by the hitch pin housing wall 60) around the bundle 24, encountering the second leg of the "V" as it does so. The groove 58 (not shown) in the first clove hitch retaining pin 56 snags the lace 42 and carries the lace 42 along the path of the pin 56. As it travels along this path, the first clove hitch retaining pin 56 recedes back into the hitch pin housing wall 60 so as to clear any other part of the lace 42 as it rotates around the bundle 24. The first clove hitch retaining pin 56 comes to rest at approximately 285 degrees, forming an "eyelet" 62 in the lace 42.

Figure 9A:
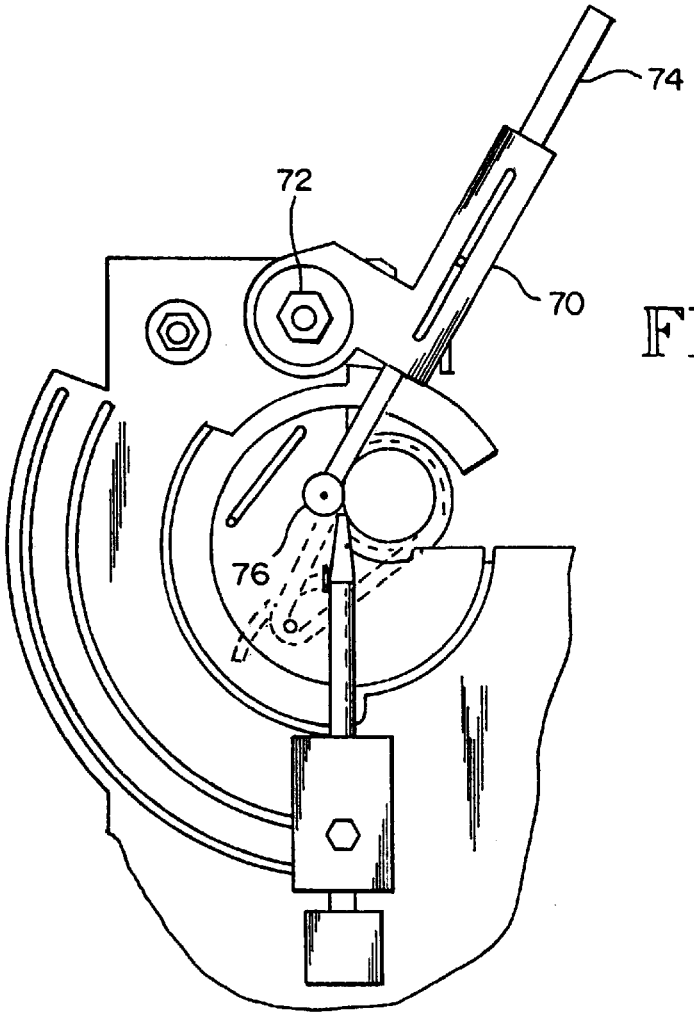
FIG. 9*a* is a detail section view of an intermediate step in the clove hitch process.
Figure 9B:
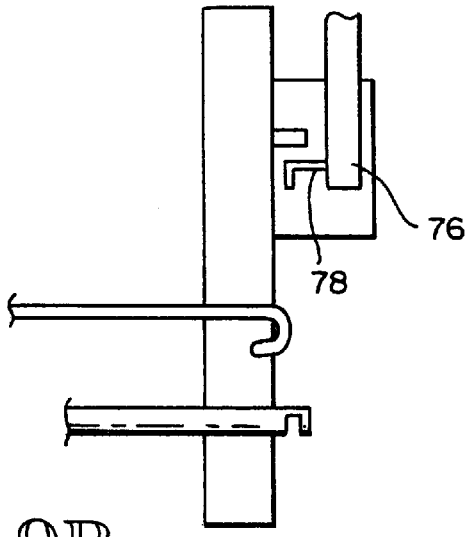
FIG. 9*b* is a front view of the intermediate step of FIG. 9*a;*

In FIG. 9*a*, the main slack pin housing 70, which lies along a plane generally parallel with the reference plane but simply off-set slightly, has pivoted clockwise on the bolt 72 so that the main slack pin 74 is brought into play. The main slack pin 74 extends from the housing 70 so that the main slack pin tip 76 is positioned within the eyelet formation 62 of the lace 42 beside the first clove hitch retaining pin 56. FIG. 9*b* shows how the hook 78, which is oriented generally orthogonal to the reference plane, has extended from the tip 76 into the eyelet 62.

Figure 10:
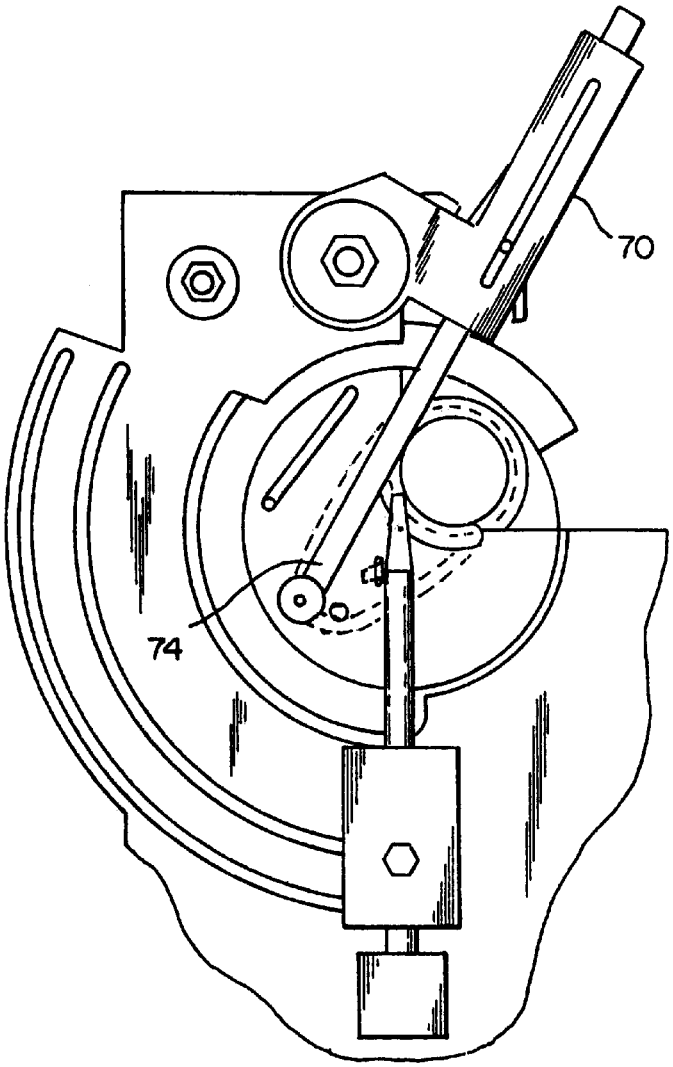
FIG. 10 is a detail section view of an intermediate step in the clove hitch process.

FIG. 10 shows how the main slack pin 74 then extends further from the housing 70 so that the tip hook 78 will snag and carry the lace 42 such that only a small amount of free end of the lace 42 is remaining pinned by the main hook 54 to the extension pin housing wall 52.

Figure 11:
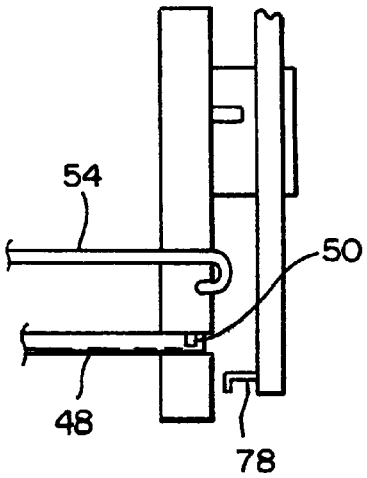
FIG. 11 is a front detail section view of the final step in the clove hitch process.

To complete the clove-hitch process, the loop slack pin 48 then twists approximately 180 degrees to release the lace 42 from the groove 50 and then recedes back into the wall 52 so that the loop slack pin 48 is now out of play. FIG. 11 shows the loop slack pin 48 after having receded. The lace 42 now hangs loosely around the bundle 24 and the clove hitch is complete.

Figure 12A:
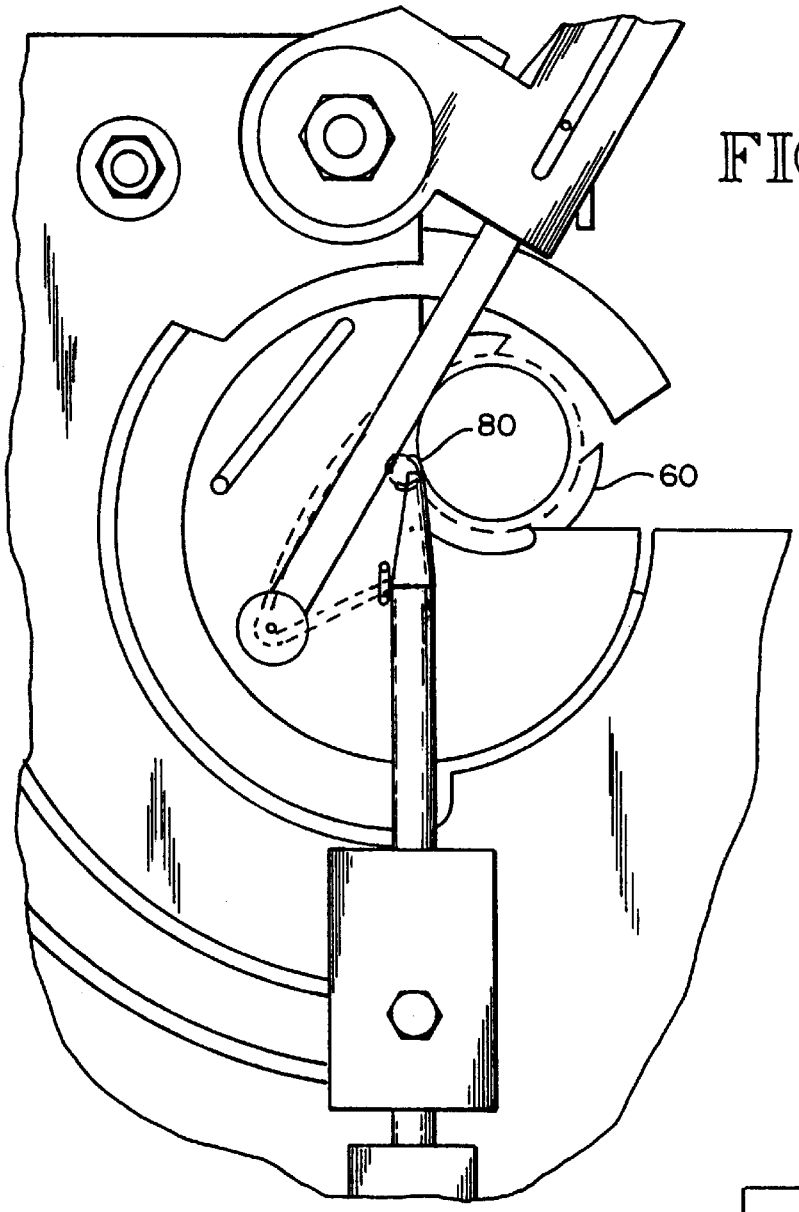
FIG. 12*a* is a detail section view of an intermediate step in the surgeon's knot process.
Figure 12B:
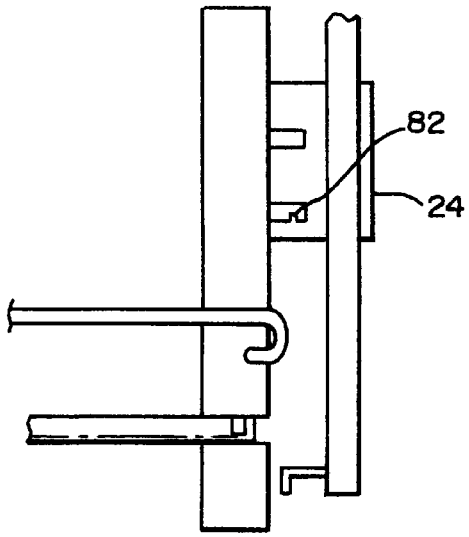
FIG. 12*b* is a front view of the intermediate step of FIG. 12*a;*

FIG. 12*a* shows the next intermediate step. In order to maintain the integrity of the clove hitch during the next phase of the knot-tying process, the second clove hitch retaining pin 80, which is oriented generally orthogonal to the reference plane, extends from the hitch pin housing wall 60, capturing within the groove 82 the portion of the lace 42 being fed from the nozzle 38. Now begins the process of tying the surgeon's knot to secure the clove hitch around the bundle 24. FIG. 12*b* is a front view of this intermediate step.

In FIG. 13*a*, first the nozzle tube 36 retracts within the nozzle housing 32. Then the nozzle assembly 30 begins its journey along the nozzle tracks 40 and continues until the nozzle tip 38 is positioned beneath the taut strand of lace 42 between the main slack pin 74 and the main hook 54. The nozzle tube 36 twists, if necessary, so that the gap between the nozzle tab 84 (shown in FIG. 13*b*) and the nozzle tip 38 is then aimed at the taut strand of lace 42 in preparation to capture the lace 42 in the gap. The nozzle tube 36 then extends from the nozzle housing 32 so far as to pin the lace 42 in the gap between the nozzle tab 84 and the nozzle tip 38 against the extension pin housing wall 52. In FIG. 14, the lace 42 (not shown in this figure) is being held against the wall 52. The main hook 54 extends, releasing its own hold on the lace 42.

In FIG. 15*a*, while the nozzle assembly 30 continues to journey clockwise along the nozzle tracks 40, the nozzle tube 36 begins to twist about its own axis, so that the lace 42 is wrapped around the tip 38, as shown in FIG. 15*b*. Simultaneously, the main slack pin 74 gradually recedes so as to provide slack and allow the lace 42 to be wrapped around the nozzle tip 38, but in a way that the lace 42 is always kept taut at all times. At the end of this step, the nozzle tip 38 is positioned (as in FIG. 16) roughly between the two clove hitch retaining pins 56 and 80, and the main slack pin 74 retreats completely within its housing 70 and is pivoted away from the area proximate the bundle 24.

Figure 16:
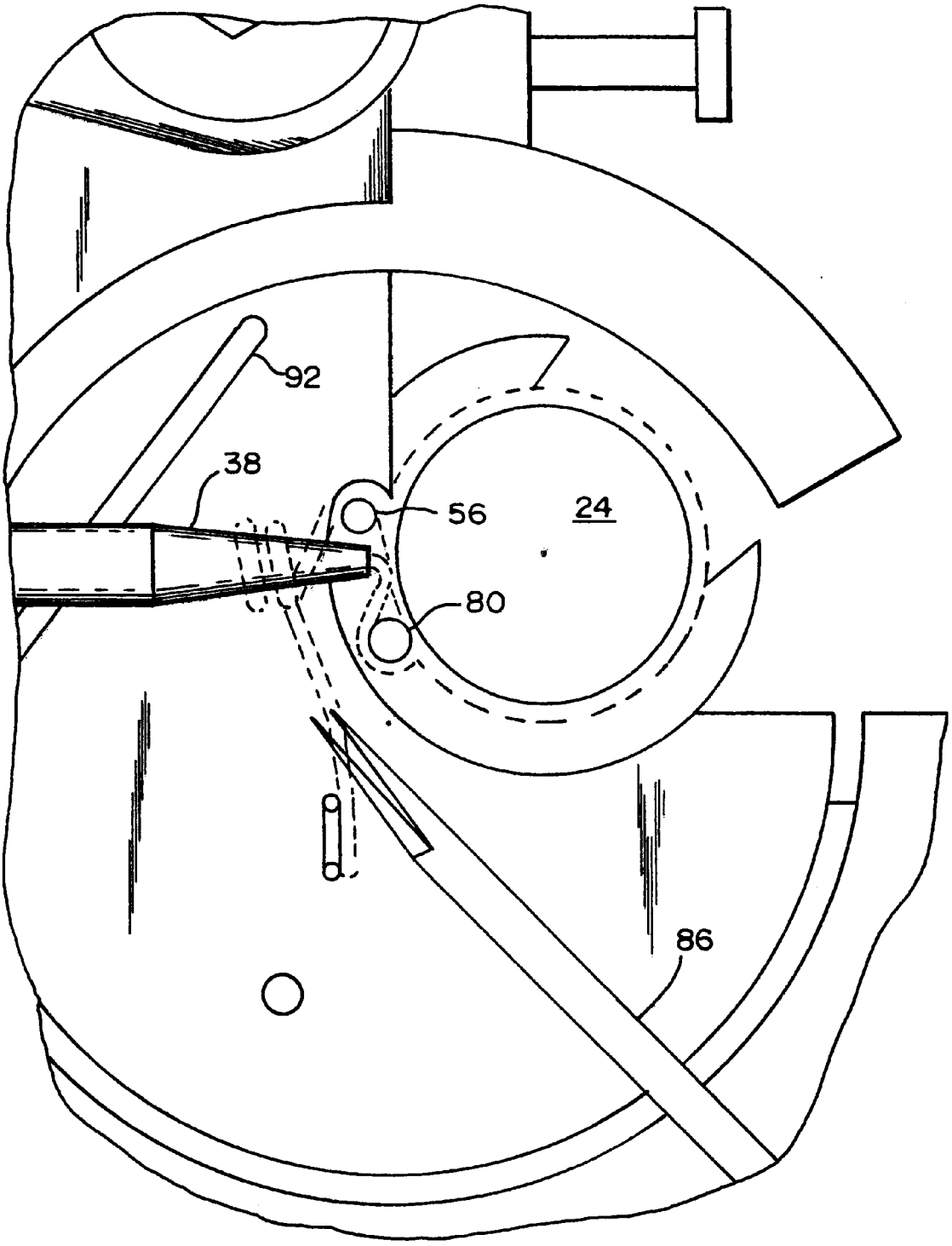
FIG. 16 is a detail section view of an intermediate step in the surgeon's knot process.

FIG. 16 shows how the tail cincher 86 extends into the knot area proximate the bundle 24 to take hold on the free end of the lace 42, which is extending from the side of the nozzle tip 38. The tail cincher 86 in the preferred embodiment is generally in the shape of a pair of tweezers or tongs and clamps the lace 42 between its two prongs. In alternate embodiments, however, the tail cincher 86 could be of any shape and could use any other means of clamping the lace 42.

Figure 17A:
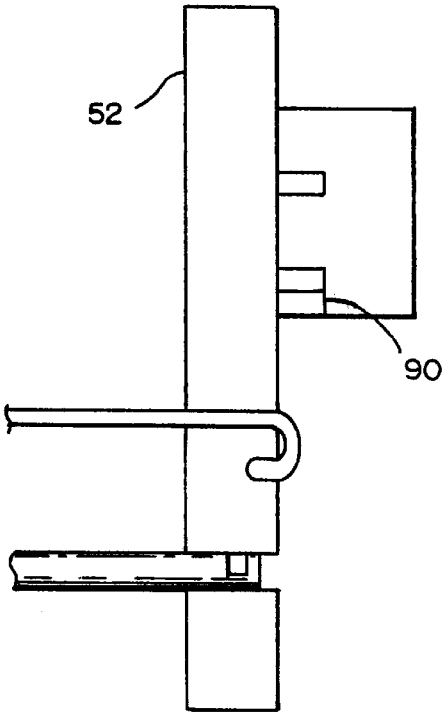
FIG. 17*a* is a detail section view of an intermediate step in the surgeon's knot process.
Figure 17B:
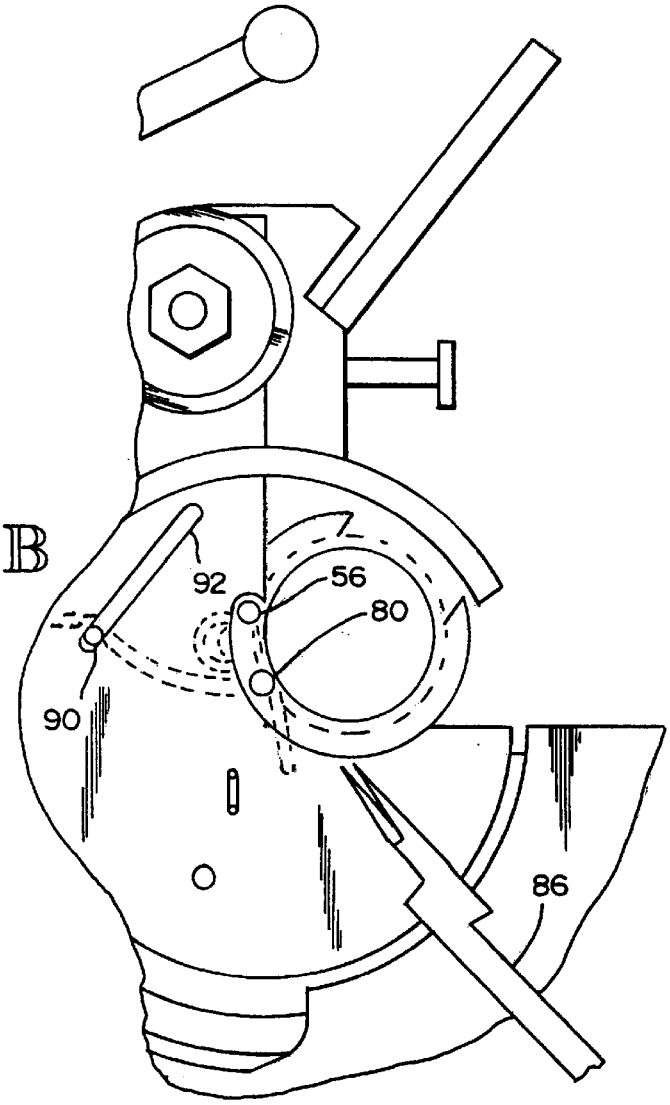
FIG. 17*b* is a front view of the intermediate step of FIG. 17*a;*

While the free end of the lace 42 is being held by the tail cincher 86, the nozzle tube 36 then retracts into the nozzle housing 32, so as to begin pulling taut the knot being formed. In FIG. 17*a*, the surgeon's knot retaining pin 90 extends from the extension pin housing wall 52 within the surgeon's knot retaining pin track 92 (shown in FIG. 17*b*). The two clove hitch retaining pins 56 and 80 twist as necessary so that their respective grooves 58 and 82 release the lace 42 and then the pins 56 and 80 retract within the wall 52. At this point, the tail cincher 86 twists approximately 180 degrees.

Figure 18:
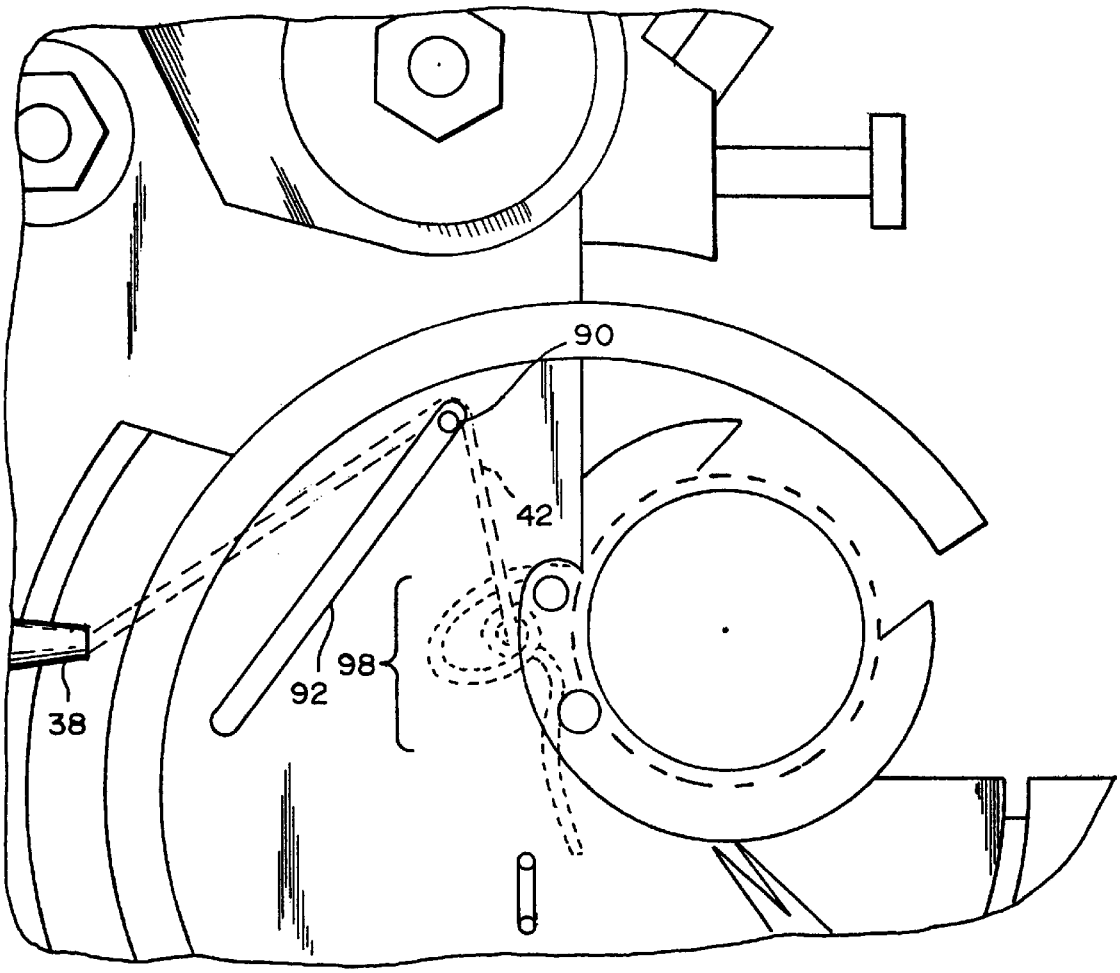
FIG. 18 is a detail section view of an intermediate step in the surgeon's knot process.

FIG. 18 shows the surgeon's knot retaining pin 90 after it has traveled as far as necessary along the track 92 to take up the slack between the nozzle tip 38 and the knot 98. The lace 42 has been caught in the groove 94 (not shown) of the pin 90, and the pin 90 retracts within the wall 52 until the lace 42 touches the wall 52.

Figure 19:
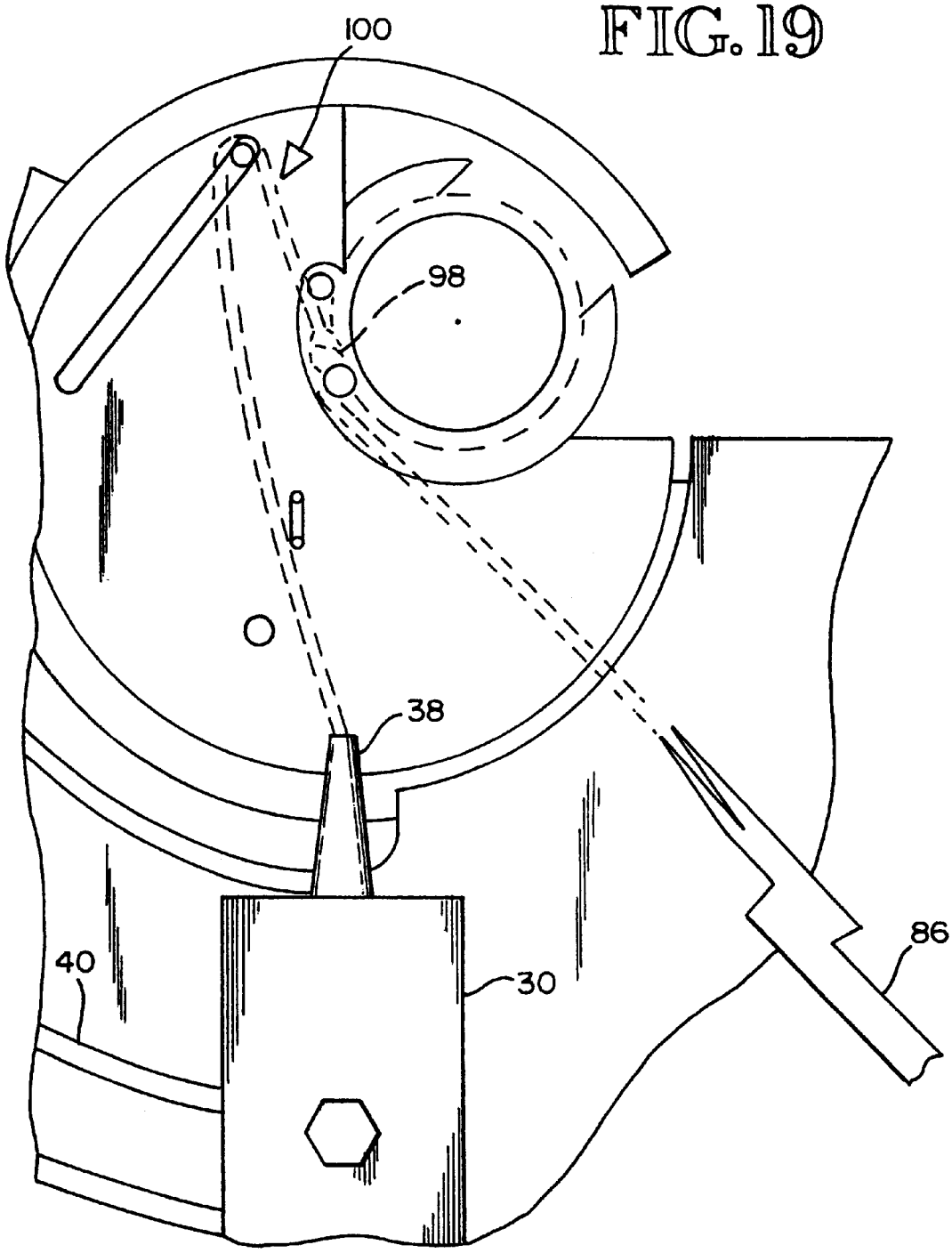
FIG. 19 is a detail section view of the final step in the surgeon's knot process.

In FIG. 19, the nozzle assembly 30 has journeyed back along the nozzle tracks 40 counterclockwise approximately to the starting position. The tail cincher 86 now also retracts, with the result that the lace 42 is pulled tightly between the tail cincher 86 and the nozzle tip 38, and the surgeon's knot 98 is finished.

Upon the completion of the knot 98, the tail cincher 86 releases the free end of the lace 42. Simultaneously, the cutting edge enters the proximity of the knot roughly between the knot 98 and the surgeon's knot retaining pin 90. After the cutting edge has cut the lace 42, the new free end of the lace 42 is carried by the retaining pin 90 back down the track 92 to be clamped to the clamp 46 on the wrapping ring 44 in preparation for the next application.

What is claimed is:

1. An apparatus for tying a filament into a discrete knot around a workpiece comprising:

a housing, said housing defining an opening for the workpiece and an interior working area, a power source connection attached to the housing, a supply of filament linked to the housing such that the filament is threaded into the interior working area of the housing, and a mechanism mounted within the interior working area of the housing, comprising a nozzle linked to the filament supply for leading the filament from the filament supply to a point proximate the workpiece, a wrapping element, swingably mounted to the housing such that the wrapping element is capable of circumscribing the workpiece, such wrapping element having a clamp for temporarily holding the lead end of the filament, and a plurality of extension pins reciprocatably mounted to the housing.

2. The apparatus of claim 1 wherein, the housing is of sufficient size and weight to be handheld.

3. The apparatus of claim 1, wherein the supply of filament is mounted outside the housing.

4. The apparatus of claim 1, wherein the filament is lace.

5. A mechanism for tying a knot around a generally cylindrical workpiece having a longitudinal axis, comprising:

a generally planar housing wall defining a reference plane and defining a generally U-shaped opening for fitting therein the workpiece such that the longitudinal axis of the workpiece is generally transverse to the reference plane, a wrapping element, swingably mounted to the housing wall, such that the wrapping element is capable of circumscribing the workpiece, a nozzle mounted to the housing wall, said nozzle comprising a hollow tube having a distal end and a proximate end, said proximate end being oriented generally toward the workpiece, and a plurality of pins reciprocatably mounted to the housing wall, said pins being arranged generally transverse to the reference plane of the housing wall, said pins having distal ends and proximate ends, said proximate ends being oriented generally toward the workpiece.

6. The mechanism of claim 5, wherein the wrapping element comprises a generally ring-shaped member, said member defining a generally arcurate opening for allowing insertion of the workpiece.

7. The mechanism of claim 6, wherein the wrapping element further comprises a clamp mounted to the ring-shaped member.

8. The mechanism of claim 5, wherein the nozzle comprises the assembly of:

a nozzle housing mounted to the housing wall, said nozzle housing defining a throughbore, said throughbore being oriented generally orthogonally to the cylindrical workpiece, a hollow, generally cylindrical nozzle body having a distal end and a proximate end, said nozzle body slidably mounted within the throughbore of the nozzle housing with the proximate end of the nozzle body oriented generally toward the workpiece, and a hollow, generally conical nozzle tip mounted at the proximate end of the nozzle body and having a smaller diameter end oriented generally toward the workpiece.

9. The mechanism of claim 8, wherein the nozzle housing of the nozzle assembly is slidably mounted to the housing wall such that the nozzle housing can slide in a plane generally parallel to the reference plane.

10. The mechanism of claim 8, wherein the nozzle body of the nozzle assembly is slidably and twistably mounted within the throughbore of the nozzle housing.

11. The mechanism of claim 8, the nozzle assembly further comprising a tab mounted to the exterior of the conical nozzle tip.

12. The mechanism of claim 5, wherein at least one of the pins defines a groove on the proximate end thereof.

13. The mechanism of claim 5, wherein at least one of the pins is reciprocatably and twistably mounted to the housing wall.

14. The mechanism of claim 5, wherein at least one of the pins is slidably mounted to the housing wall, such that the pin may slide along the wall in a plane generally parallel to the reference plane.

15. The mechanism of claim 5, further comprising a tail cincher having a distal end and a proximate end, said proximate end being oriented generally toward the workpiece.

16. The mechanism of claim 5, further comprising a cutting element.

17. A method for automatically tying a filament into a discrete knot about a generally cylindrical workpiece having a longitudinal axis, using a device comprising a hollow nozzle and a plurality of pins, said nozzle being mounted to the device and having a tip which is oriented generally toward the workpiece, and said plurality of pins being reciprocatably mounted to the device, said method comprising the steps of:

positioning the nozzle tip in proximity to the workpiece, pulling the filament through the hollow nozzle generally transversely around the workpiece, contemporaneously extending and retracting the pins into and out of the path of the pulled filament so as to form a knot, and subsequently cinching and securing the knot about the workpiece.

18. The method of claim 17, further comprising the step of:

after the knot has been secured, cutting the filament issuing from the nozzle with a cutting element, thereby leaving a discrete, finished knot secured about the workpiece.

19. The method of claim 18, further comprising the step of:

automatically retrieving the filament issuing from the nozzle and relocating it so as to set up the device for the next application.

* * * * *